US008614381B2

(12) United States Patent
Revenaugh

(10) Patent No.: US 8,614,381 B2
(45) Date of Patent: Dec. 24, 2013

(54) METHOD AND STRUCTURE FOR PORTABLE PIANO SOUND REFLECTOR

(76) Inventor: Daniell Revenaugh, Berkeley, CA (US)

( * ) Notice: Subject to any disclaimer, the term of this patent is extended or adjusted under 35 U.S.C. 154(b) by 32 days.

(21) Appl. No.: 13/468,570

(22) Filed: May 10, 2012

(65) Prior Publication Data

US 2013/0298745 A1 Nov. 14, 2013

(51) Int. Cl.
*G10C 3/06* (2006.01)

(52) U.S. Cl.
USPC ..... 84/189

(58) Field of Classification Search
USPC ..... 84/189
See application file for complete search history.

(56) References Cited

U.S. PATENT DOCUMENTS

| | | | | | |
|---|---|---|---|---|---|
| 390,169 | A | * | 9/1888 | Hudson | 84/189 |
| 562,236 | A | * | 6/1896 | Ogden et al. | 84/189 |
| 758,694 | A | * | 5/1904 | Riggins | 84/189 |
| 763,157 | A | * | 6/1904 | Clark | 84/189 |
| 831,852 | A | * | 9/1906 | Freeborne | 84/189 |
| 950,276 | A | * | 2/1910 | Clark | 84/189 |
| 1,121,166 | A | * | 12/1914 | Clark | 84/189 |
| 1,530,984 | A | * | 3/1925 | Crippen | 84/189 |
| 1,981,092 | A | * | 11/1934 | Georges | 84/189 |
| 2,134,680 | A | * | 11/1938 | Dunbar | 84/189 |
| 2,412,212 | A | * | 12/1946 | Gerlat | 84/189 |
| 2,948,179 | A | * | 8/1960 | Hideo et al. | 84/198 |
| 3,535,974 | A | * | 10/1970 | Habig | 84/177 |
| 3,721,148 | A | * | 3/1973 | Goss | 84/189 |
| 4,211,142 | A | * | 7/1980 | Conklin, Jr. | 84/189 |
| 5,301,588 | A | * | 4/1994 | Revenaugh et al. | 84/177 |
| 6,080,924 | A | * | 6/2000 | Cowen et al. | 84/453 |
| 6,288,313 | B1 | * | 9/2001 | Sato et al. | 84/177 |
| RE38,172 | E | * | 7/2003 | Revenaugh et al. | 84/177 |
| 7,528,311 | B2 | * | 5/2009 | Terada et al. | 84/410 |

OTHER PUBLICATIONS

Strong, Jeff, Home Recording for Musicians for Dummies, 4th Edition, Nov. 2011.*

* cited by examiner

*Primary Examiner* — David Warren
*Assistant Examiner* — Robert W Horn
(74) *Attorney, Agent, or Firm* — J. Wiley Horton

(57) ABSTRACT

A portable sound reflector designed to be placed under the soundboard of a piano in order to reflect sound laterally. The preferred embodiment includes a main panel which is held in the proper reflecting orientation by a pair of lateral wings. The lateral wings are preferably hinged to the main panel so that the entire assembly may be folded flat for transportation and storage. A pair of automatically-deploying stays are preferably included. These fold outward and downward to latch the lateral wings in the deployed state when the device is to be used. The hinges are preferably spring-biased toward the open position. This allows the device to assist the user in the unfolding process.

20 Claims, 15 Drawing Sheets

METHOD AND STRUCTURE FOR PORTABLE PIANO SOUND REFLECTOR

CROSS-REFERENCES TO RELATED APPLICATIONS

Not Applicable.

STATEMENT REGARDING FEDERALLY SPONSORED RESEARCH OR DEVELOPMENT

Not Applicable

MICROFICHE APPENDIX

Not Applicable

BACKGROUND OF THE INVENTION

1. Field of the Invention

This invention relates to the field of musical performances. More specifically, the invention comprises a portable sound reflector designed to be placed beneath the sound board of a piano, and a method for using the sound reflector.

2. Description of the Related Art

FIG. 1 shows a prior art piano 10. The type of piano shown is a concert grand, which includes a horizontally oriented sound board within frame 12. Lid 14 covers the top of the frame. Legs 16 support the frame. Keyboard assembly 20 is located on the front of the piano, along with pedal assembly 18.

When such a piano is played before an audience, it is customary to raise lid 14. FIG. 2 shows the same piano with lid 14 in the raised position. Hinge 26 allows the lid to be rotated through an arc. Brace 22 locks into retainer 24 to hold the lid in the raised position. In this configuration the lid reflects the sound originating within frame 12 out toward the audience (to the right in the orientation shown in the view).

The present inventor previously conceived and developed a device to increase the volume of projected sound from such a piano. FIG. 3 shows the device—lower lid 30. Lower lid 30 is connected to the bottom of frame 12 via hinge 27. Pianos traditionally lack any sort of lower lid. The frame is simply open on the bottom. Although the bottom of the soundboard radiates an amount of acoustic energy that is comparable to the top, this energy is traditionally "wasted" because it is not projected toward the audience. The lower lid invention solves this problem. As shown in FIG. 3, reflected sound 34 is reflected laterally by both lid 14 and lower lid 30. The inventor filed for a patent on the lower lid invention, and this application was ultimately issued as U.S. Pat. No. 5,301,588.

While the invention described in U.S. Pat. No. 5,301,588 is quite effective in projecting sound, it has certain shortcomings. First, the invention must be incorporated into the structure of the piano itself. This is not particularly difficult for newly constructed pianos, but it is not easily retrofitted to old pianos. In addition, many older concert pianos are quite valuable and the owners are naturally reluctant to drill holes or otherwise modify the piano from its original state.

The '588 invention also alters the appearance of the piano. Certain audience members expect a concert piano to appear exactly as it has appeared for the past two centuries, and are hostile to the idea of aesthetic variation even when it significantly improves the sound quality.

Finally, the '588 invention is obviously part of the piano, and not something that the pianist can carry along from venue to venue. Many pianists desire the enhanced sound available from the lower lid. However, the pianist obviously cannot carry a piano along in his or her travels and must instead perform using whatever configuration resides in the venue.

Accordingly, it would be desirable to provide a sound reflector analogous to the lower lid in the '588 patent, while also being portable and aesthetically unobtrusive. The present invention provides such a solution.

BRIEF SUMMARY OF THE INVENTION

The present invention comprises a portable sound reflector designed to be placed under the soundboard of a piano in order to reflect sound laterally. The preferred embodiment includes a main panel which is held in the proper reflecting orientation by a pair of lateral wings. The lateral wings are preferably hinged to the main panel so that the entire assembly may be folded flat for transportation and storage.

A pair of automatically-deploying stays are preferably included. These fold outward and downward to latch the lateral wings in the deployed state when the device is to be used. The hinges are preferably spring-biased toward the open position. This allows the device to assist the user in the unfolding process.

REFERENCE NUMERALS IN THE DRAWINGS

| | | | |
|---|---|---|---|
| 10 | piano | 12 | frame |
| 14 | lid | 16 | leg |
| 18 | pedal assembly | 20 | keyboard assembly |

-continued

| | | | |
|---|---|---|---|
| 22 | brace | 24 | retainer |
| 26 | hinge | 28 | hinge |
| 30 | lower lid | 32 | portable sound reflector |
| 34 | reflected sound | 36 | main panel |
| 38 | right wing | 40 | hinge |
| 42 | hinge | 44 | left wing |
| 46 | top fold | 48 | left hinge |
| 50 | slot | 52 | left stay |
| 54 | contact tab | 56 | left stay hinge |
| 58 | left block | 60 | angle piece |
| 62 | abutment stop | 64 | abutment stop |
| 66 | center hinge | 68 | main panel half |
| 70 | split panel embodiment | | |

DETAILED DESCRIPTION OF THE INVENTION

Figure 1:
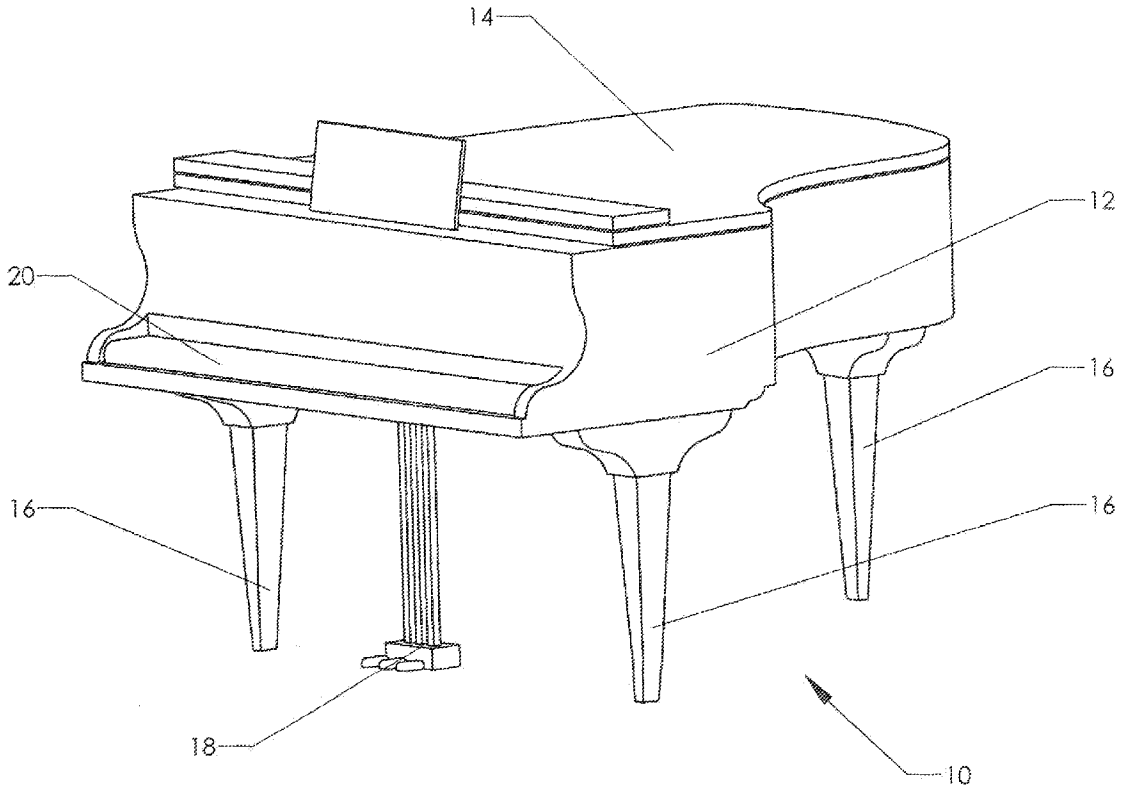
FIG. 1 (PRIOR ART)
FIG. 1 is a perspective view, showing a prior art concert piano.
Figure 2:
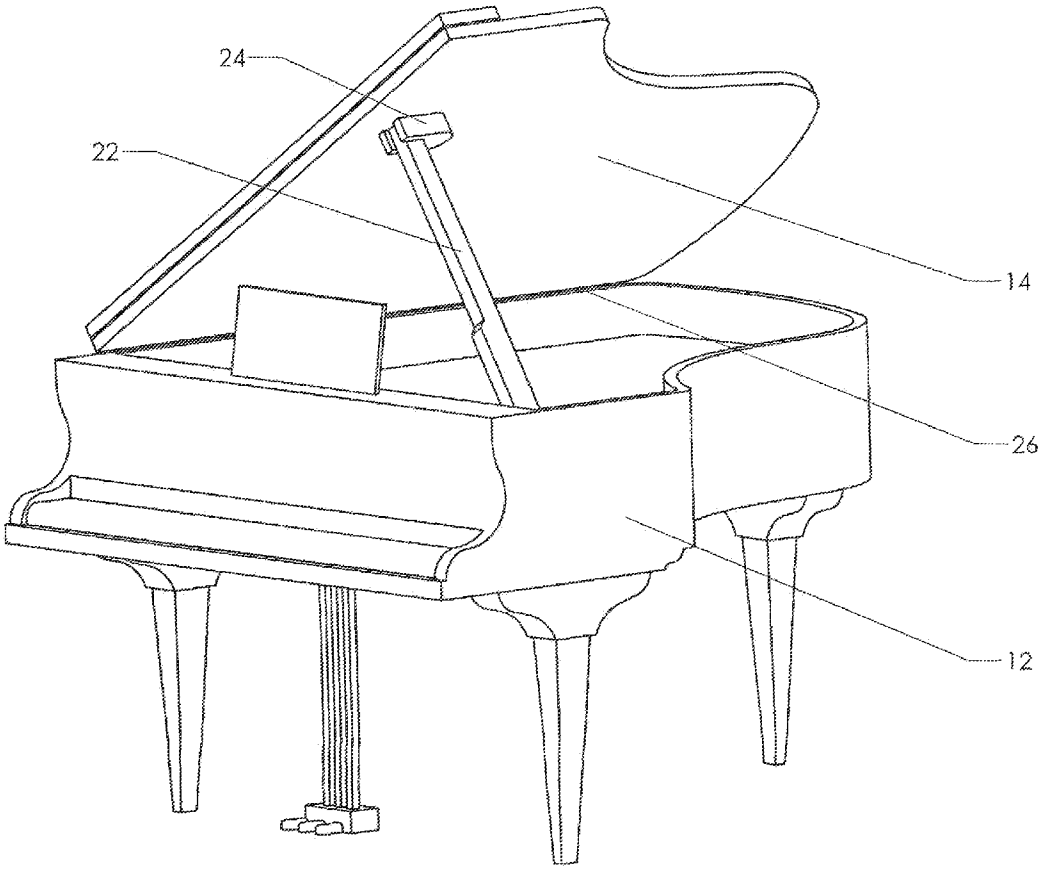
FIG. 2 (PRIOR ART)
FIG. 2 is a perspective view, showing the piano of FIG. 1 with the lid propped open.
Figure 3:
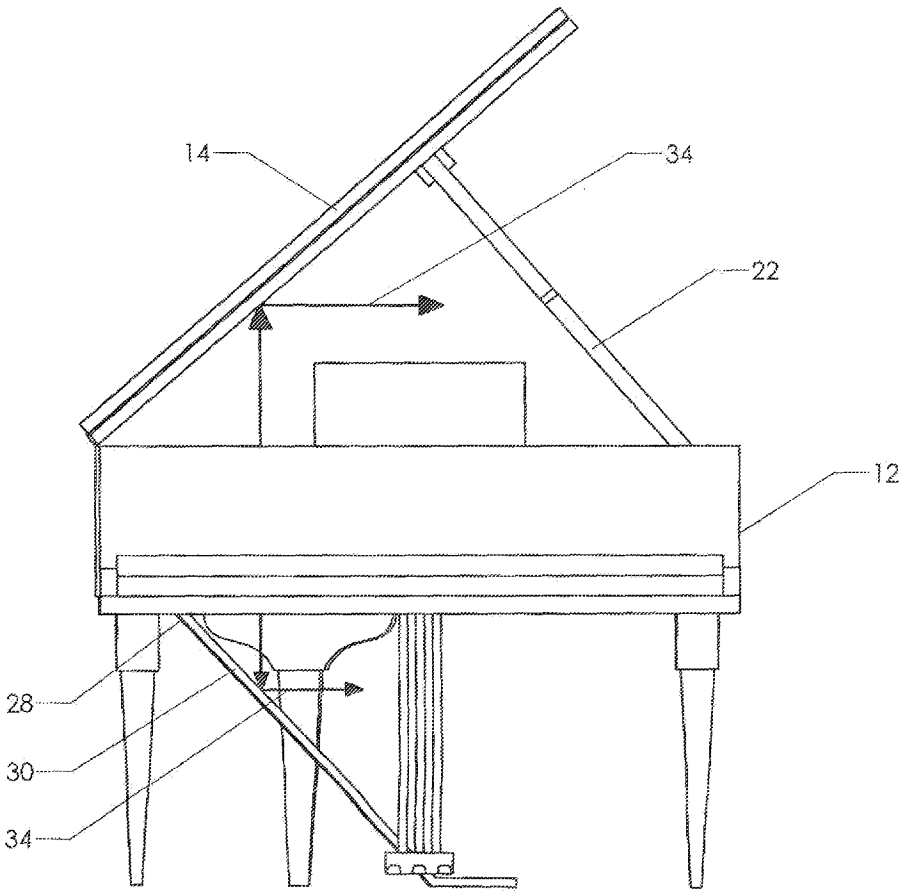
FIG. 3 (PRIOR ART)
FIG. 3 is an elevation view, showing the piano of FIG. 2 with the addition of a lower lid.
Figure 4:
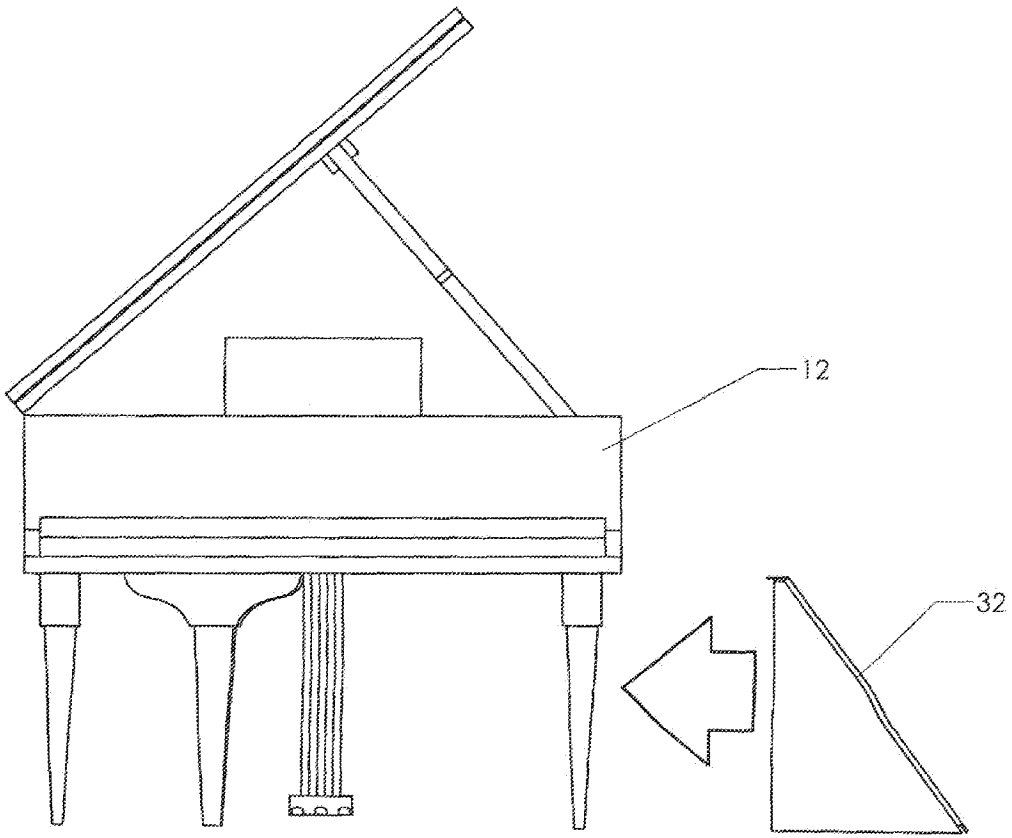
FIG. 4 is an elevation view, showing a conventional piano and the proposed invention.

FIG. 4 shows a prior art piano without an attached lower lid. Portable sound reflector 32 is provided to reflect the sound energy traveling downward from the horizontally-oriented soundboard within the piano. Portable sound reflector 32 is placed on the floor as shown. One method of installing the reflector under the piano is to place it as shown and then slide it in the direction of the arrow. It may also be placed beneath he piano without sliding.

Figure 5:
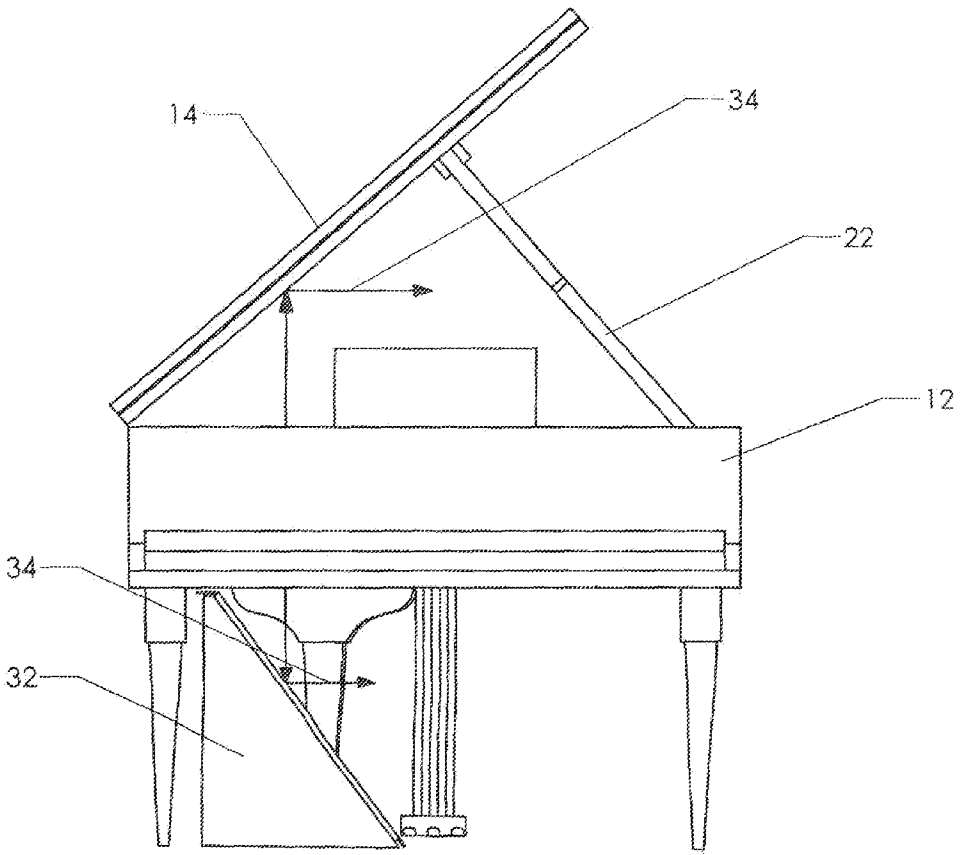
FIG. 5 is an elevation view, showing the proposed invention placed beneath a traditional piano.

FIG. 5 shows portable sound reflector 32 in a suitable position under the piano. Reflected sound 34 travels laterally after striking portable sound reflector 32. The position of the sound reflector may be varied to suite the tastes of the individual user, and the position shown in FIG. 5 should be viewed as one possible position among many.

The portable sound reflector should have an angled reflecting surface suitable in order to project the sound energy laterally toward the audience. The reflecting surface may be held in position by a virtually endless variety of devices. FIGS. 6-12 illustrate two preferred embodiments of such devices.

Figure 6:
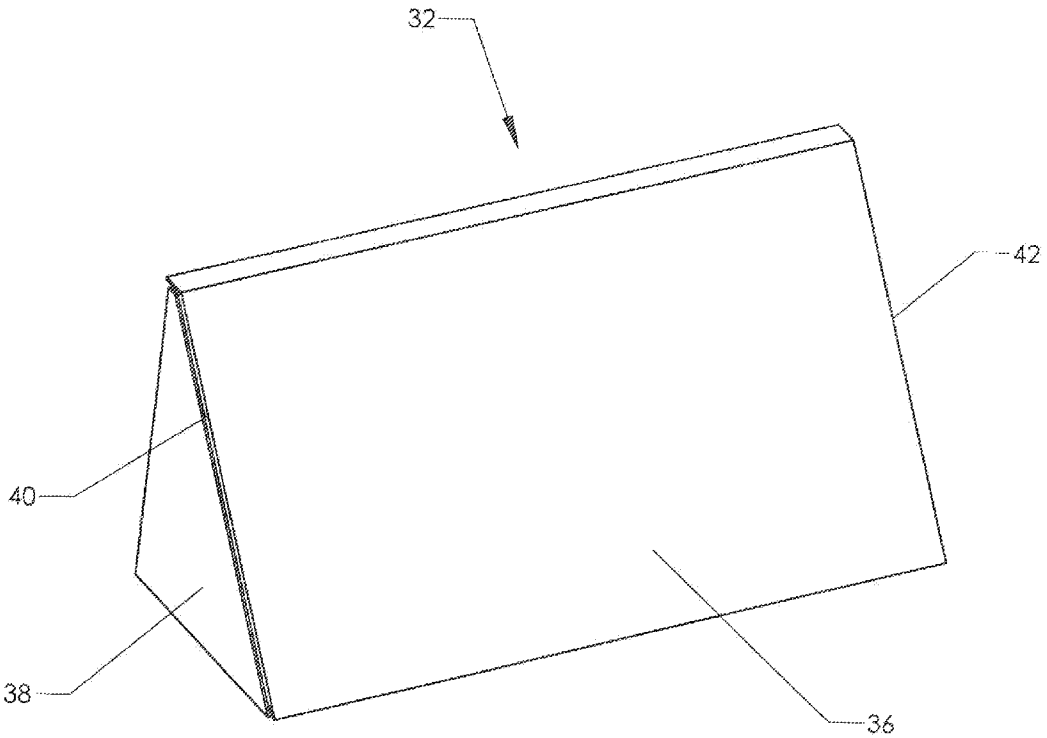
FIG. 6 is a perspective view, showing an embodiment of the proposed invention from the front.

FIG. 6 shows main panel 36 being stabilized in position by a pair of wings. Right wing 38 is pivotally connected to main panel 36 via hinge 40. A left wing—not visible in FIG. 6—is pivotally connected to main panel 36 via hinge 42. The hinges allow the two wings to be folded in against the main panel so that the reflector may be stored and transported in a collapsed (flat) state.

Figure 7:
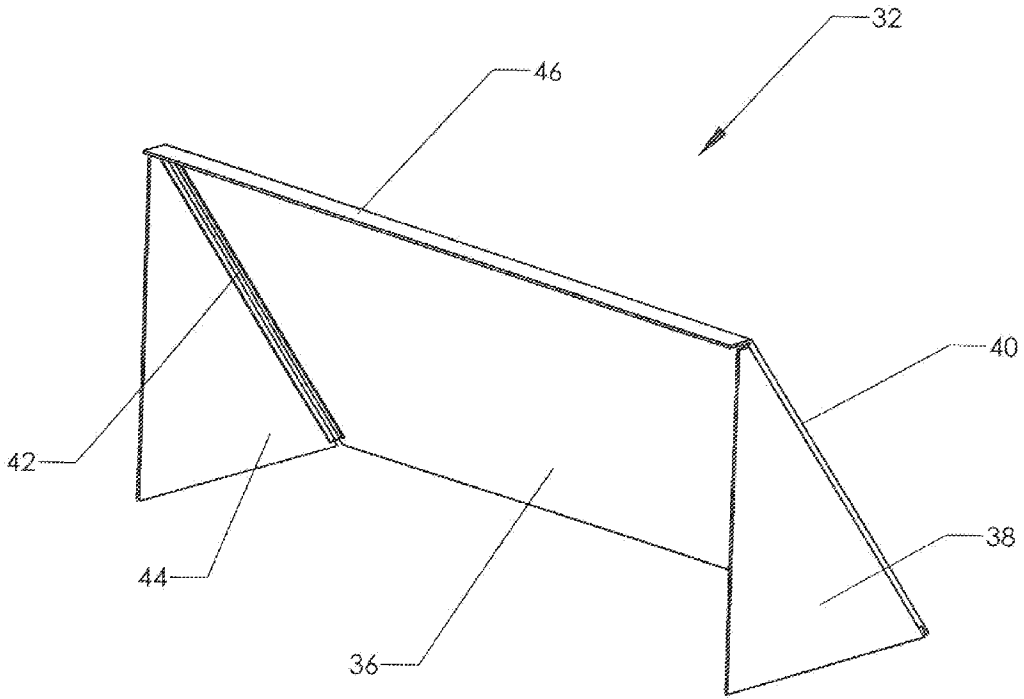
FIG. 7 is a perspective view, showing the embodiment of FIG. 6 from the rear.

FIG. 7 shows the same embodiment from the rear. Left wing 44 is visible in this view. The reader will observe that left wing 44 is pivotally attached to main panel 36 by hinge 42. The inventor has discovered that a relatively rigid main panel provides better performance. Accordingly, top fold 46 is added along the upper edge of the main panel to provide rigidity. Reinforcing ribs or other stiffening components could be used as well.

Many different materials can be used for the main panel and the wings. The main panel in one preferred embodiment is made of 0.375 inch (10 mm) thick clear acrylic. This provides good performance when stiffened by top fold 46. Clear acrylic may also be used for the left and right wings—though possibly of a lesser thickness. While the use of a clear material is not significant to the actual performance of the invention, it does provide an aesthetically pleasing effect. The portable sound reflector is placed beneath the piano, where it is in shadow. The use of the clear material allows stage lighting from the area behind the piano to be visible to the audience. The result is that most audience members do not even notice the presence of the portable sound reflector.

Once placed in position, it is important for the reflector to remain stable. Accordingly, the left and right wings in FIG. 7 should be retained in the deployed position shown by a suitable mechanism or mechanisms. Again, there are many different types of mechanisms which could be used. FIGS. 8-12 illustrate one possible mechanism.

Figure 8:
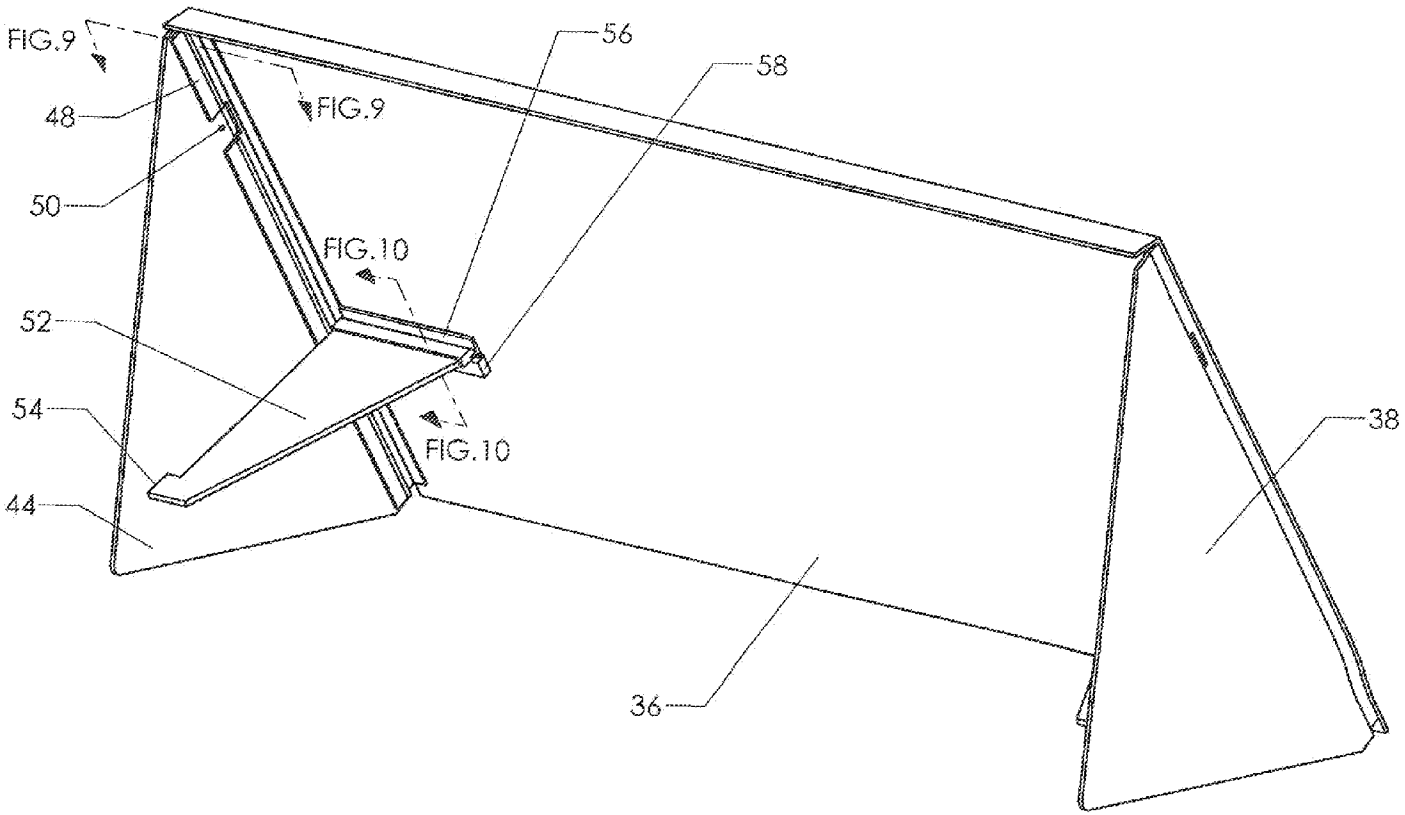
FIG. 8 is a perspective view, showing the rear of a preferred embodiment of the invention.

FIG. 8 shows a rear view of the portable sound reflector in the deployed state (right wing 38 and left wing 44 un-folded and positioned to support main panel 36). Left stay 52 is pivotally attached to main panel 36 by left stay hinge 56. It pivots between a folded position and a deployed position. Left stay 52 is shown in the deployed position in FIG. 8. Contact tab 54 bears against the inward facing surface of left wing 44. This prevents left wing 44 from folding inward.

Left wing 44 is prevented from rotating further outward by the operation of left hinge 48, which will be explained shortly. Left stay 52 is prevented from pivoting further downward by left block 58, the operation of which will also be explained shortly.

A mirror image of the stay mechanism for left wing 44 is provided for right wing 38. However, in the vantage point of FIG. 8, the stay mechanism for the right wing is hidden behind the right wing and cannot be seen.

Figure 9:
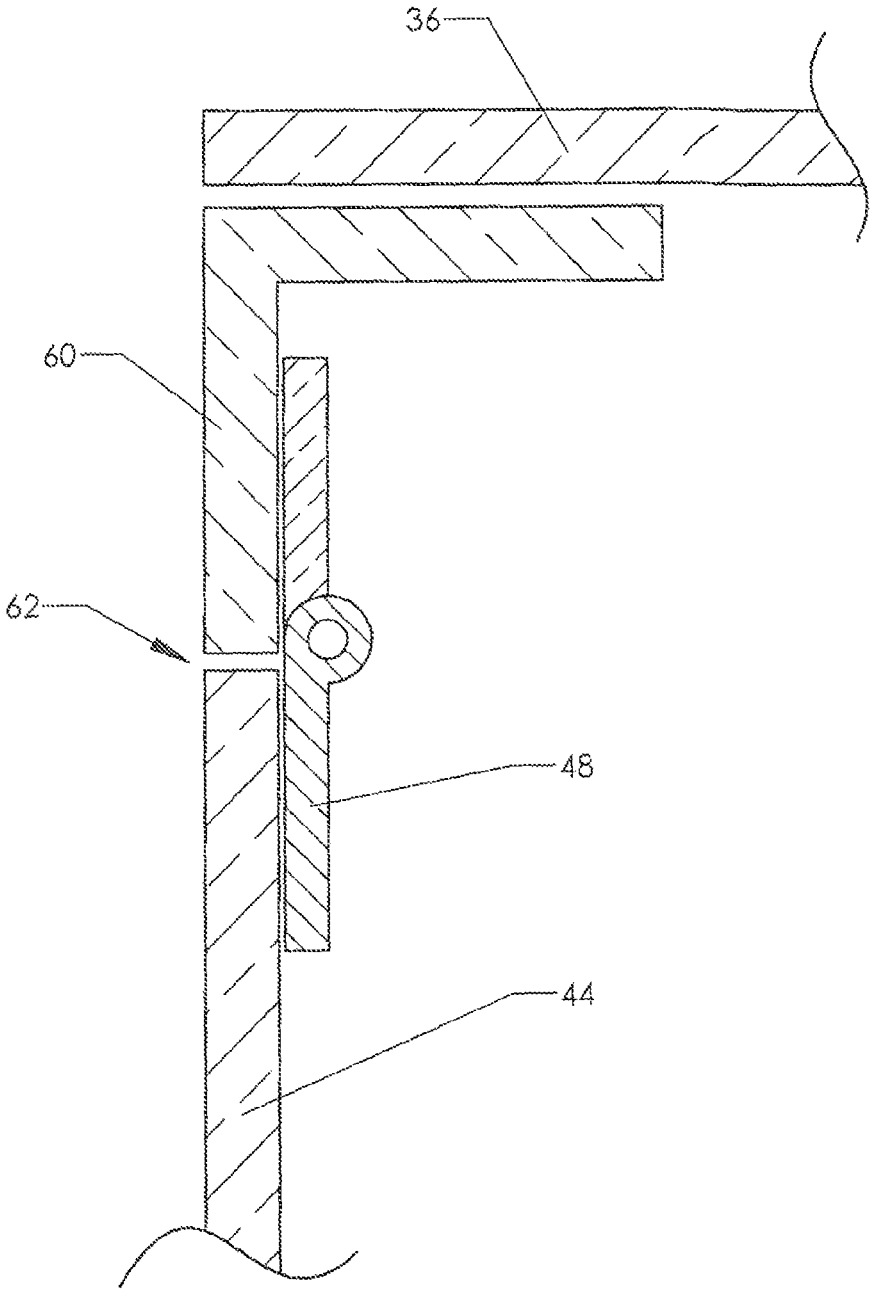
FIG. 9 is a section view through the hinge joining the main panel to the left wing.
Figure 10:
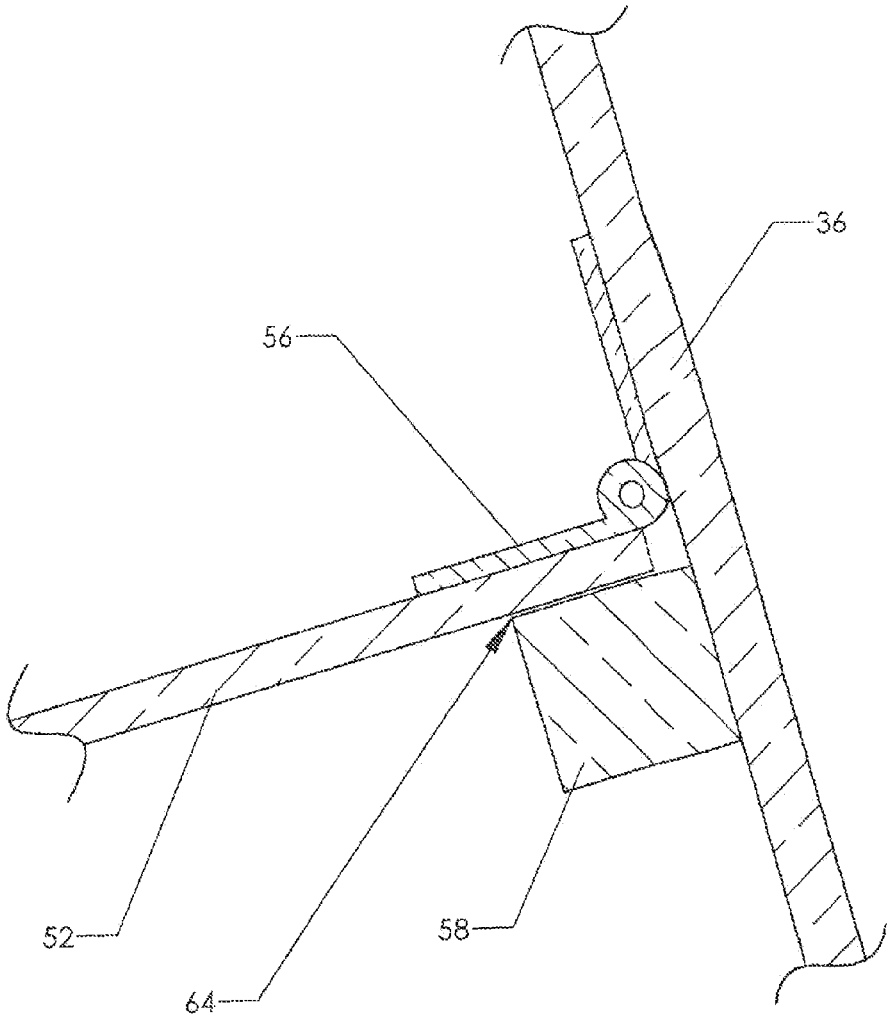
FIG. 10 is a section view through the hinge joining the left stay to the main panel.

The reader will note in FIG. 8 that two detailed section views are called out. FIG. 9 is a section through the area of left hinge 48, while FIG. 10 is a section through the area of left stay hinge 56. FIG. 9 shows one possibility for mounting the left hinge. Angle piece 60 is attached to main panel 36. Any suitable joining technique may be used for all the joints in the present invention, including the user of fasteners, spot stakes, adhesives, or the like. In the preferred embodiment, angle piece 60 is glued to main panel 36. Left hinge 48 is likewise glued to angle piece 60 and left wing 44.

In studying the geometry of FIG. 9, the reader will perceive that left wing 44 is free to fold inward toward main panel 36, but is restricted from rotating further outward by the creation of abutment stop 62. The abutment stop prevents unwanted further external rotation.

FIG. 10 shows how one half of left stay hinge 56 is attached to main panel 36 while the other half is attached to left stay 52. Left block 58 is attached to main panel 36 in order to create abutment stop 64. In studying this geometry, the reader will note that left stay 52 is free to rotate upward toward main panel 36 but is restricted from rotating further downward from the position shown in FIG. 10. FIG. 10 shows the deployed state for left stay 52 (corresponding to the view of FIG. 8).

Figure 11:
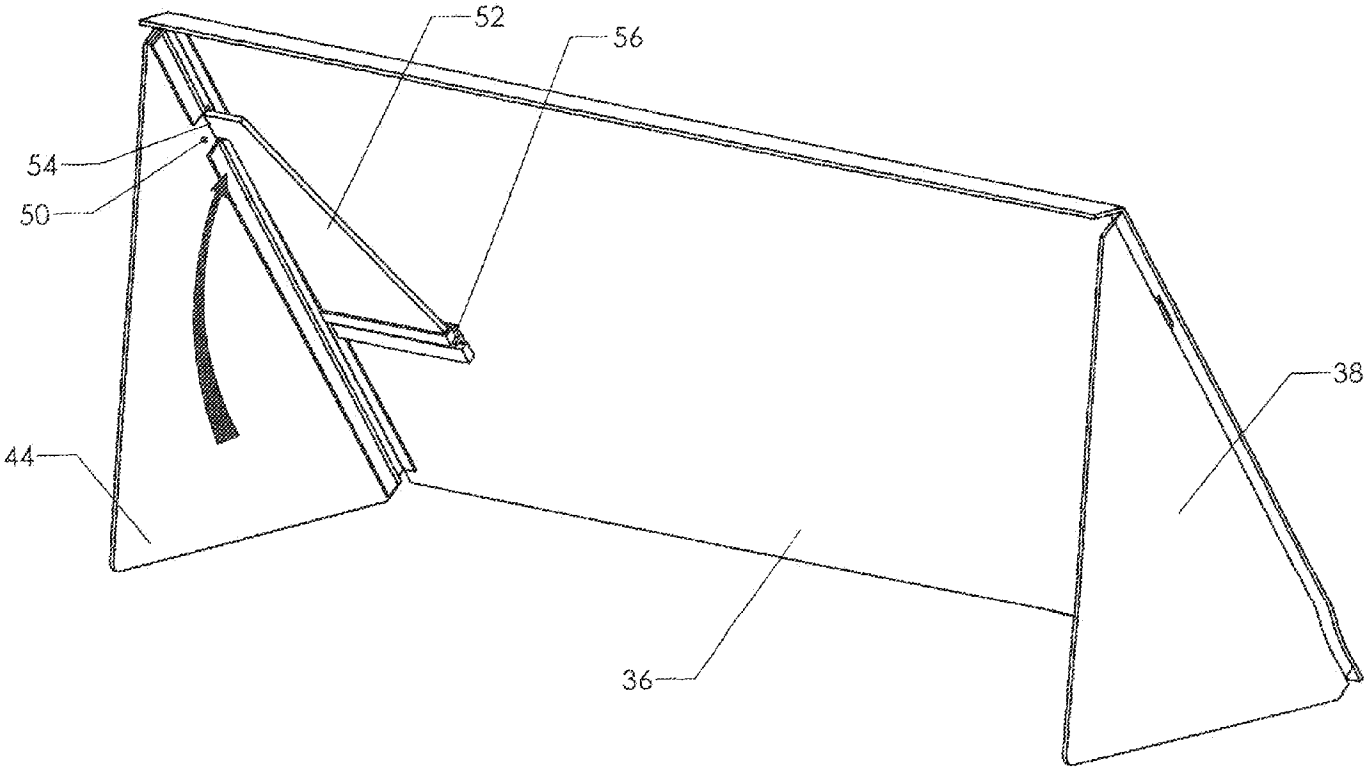
FIG. 11 is a perspective view, showing the first step in the folding process whereby the invention is transitioned from the deployed state to the folded state.
Figure 12:
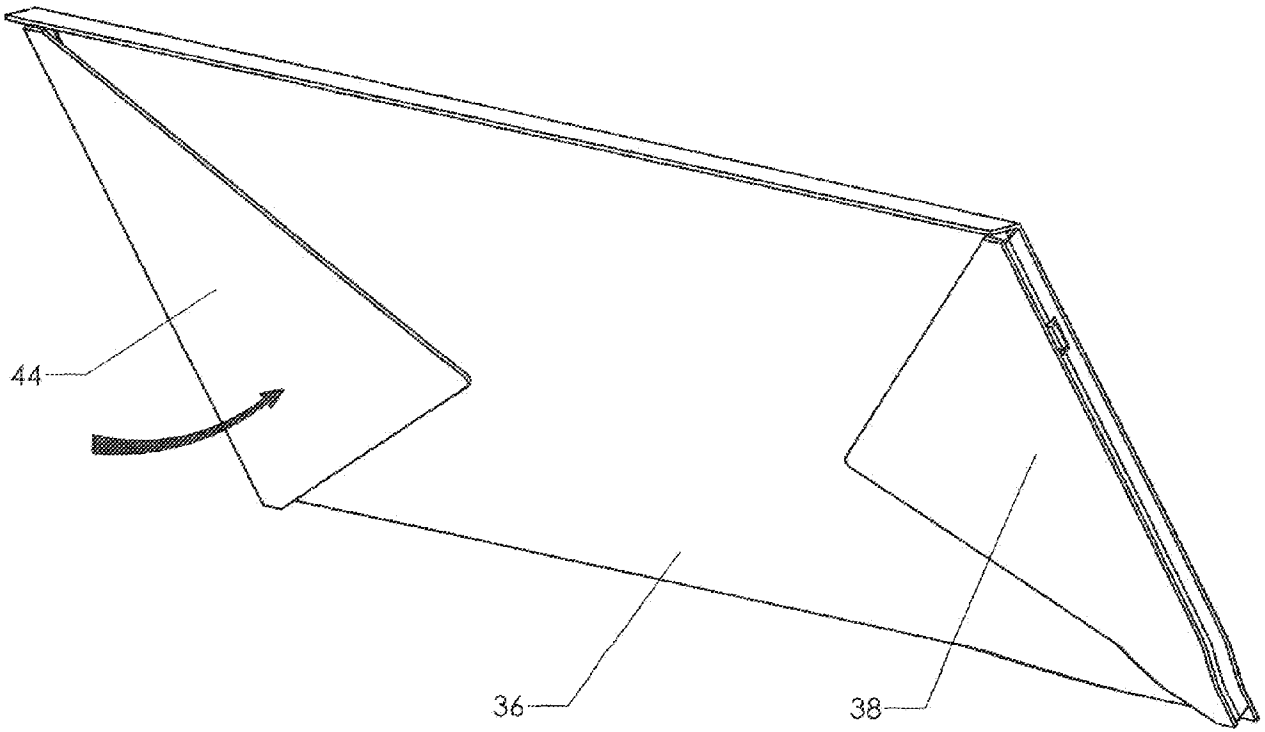
FIG. 12 is a perspective view, showing the invention in the folded state.

FIGS. 11 and 12 illustrate the process of converting the sound reflector from its deployed state to its folded state. To fold the device, left stay 52 is rotated up against main panel 36 as shown. In the folded state the left stay is approximately parallel to main panel 36 (within about 20 degrees of being parallel). Slot 50 is provided in the left hinge to allow contact tab 54 to clear.

Once left stay 52 is in the position shown, the user may grasp left wing 44 and fold it inwards. The same may be done for the right stay and right wing 38. FIG. 12 shows the sound reflector of FIG. 11 in a folded state. The reader will observe that it is a flat object having a minimal thickness. This configuration allows the reflector to be easily transported and stored. In fact, a pianist desiring to consistently use the reflector can simply carry it along on tour.

Returning now to FIG. 8, additional design features of the sound reflector will be described. In order to ease the transition of the device from the folded to the deployed state, springs are preferably provided. A first spring is provided within left hinge 48. This is preferably a torsional spring which tends to bias left wing 44 into a deployed position. A second spring may be provided for left stay 52. This second spring is preferably also a torsional spring. It tends to bias left stay 52 from the folded position to the deployed position. Additional springs are provided for the mechanisms of the right wing which perform the same functions.

Returning now to FIG. 12, the unfolding of the reflector will be described. If the reflector is stowed in a case, the user will first pull it free. The user then rotates the left and right wings into the deployed position. The springs biasing the left and right wings toward this position assist in the opening and—if suitably strong springs are provided—may even automate this process.

The reflector will then be in the condition shown in FIG. 11. Once left wing 44 swings into the deployed position, slot 50 will release contact tab 54. The biasing spring across left stay hinge 56—aided by gravity—will then rotate left stay 52 down into the deployed position. The same sequence occurs in the mechanisms for the right wing. The user will thereby understand the folding and deploying of the device.

Figure 13:
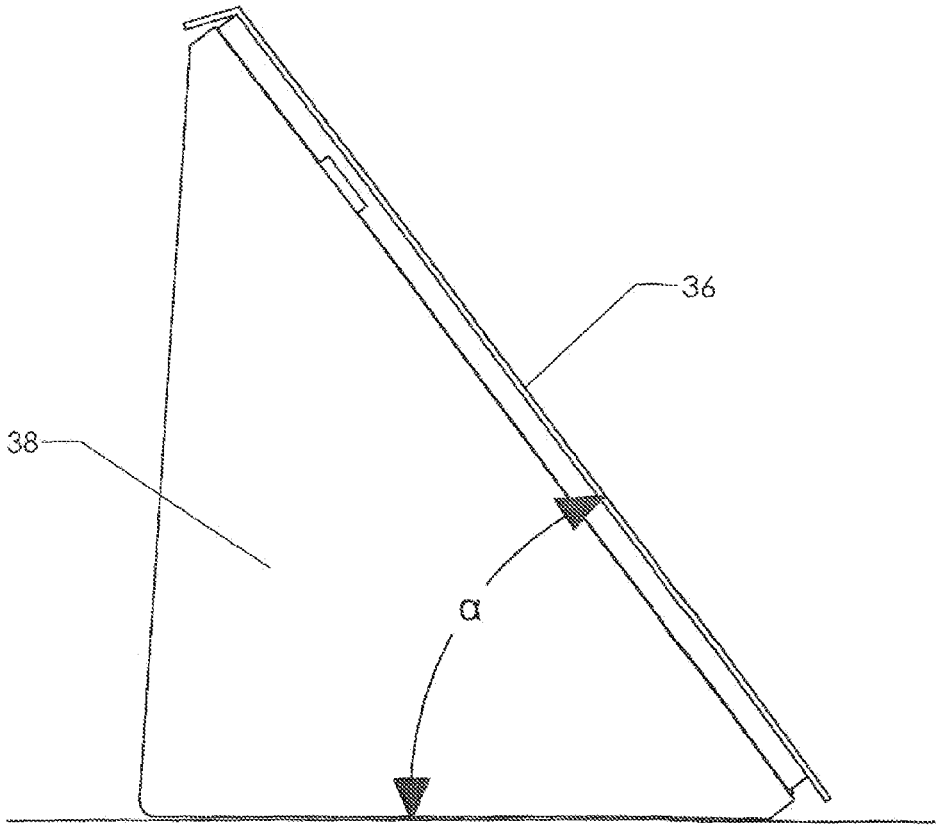
FIG. 13 is a side elevation view, showing how the invention stands on the floor in the deployed state.

Turning now to FIG. 13, some preferred dimensions will be discussed for the invention. The inventor has discovered that the angle ($\alpha$) between the main panel 36 and the floor is preferably in the range of 30 degrees to 75 degrees, more preferably in the range of 50 degrees to 60 degrees, and most preferably about 54 degrees.

Returning now to FIG. 6, main panel 36 preferably has a height of about 24-36 inches and a width of about 60-70 inches. The fold across the top of the main panel is preferably about 1.5 to 2 inches deep.

In the examples shown, the main panel and wings contact the floor along a bottom edge of each. This need not always be the case, since points or multiple points of contact could be provided for each (such as adjustable rubber feet). The sound reflector as a whole needs three lower contacting portions to be stable, but these need not assume any particular form.

Figure 14:
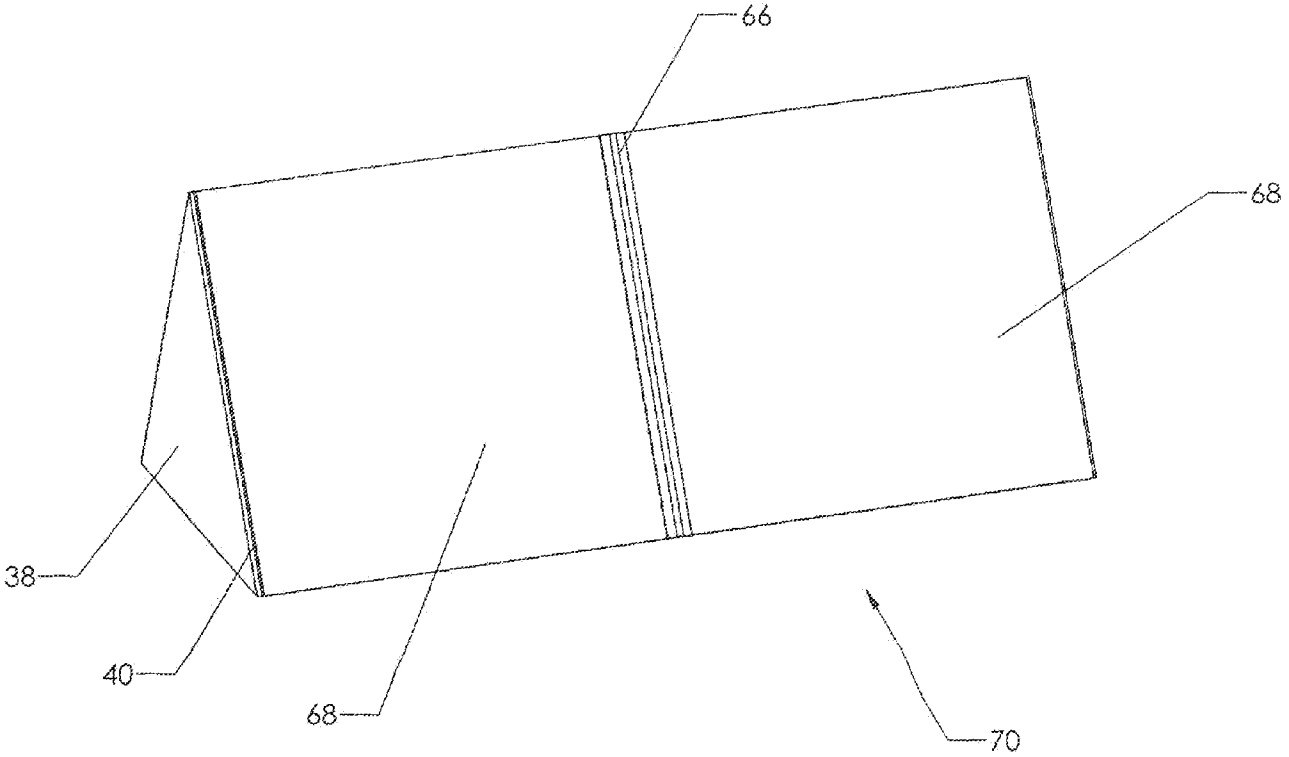
FIG. 14 is a perspective view, showing an alternate embodiment in which the main panel is split into two pieces.
Figure 15:
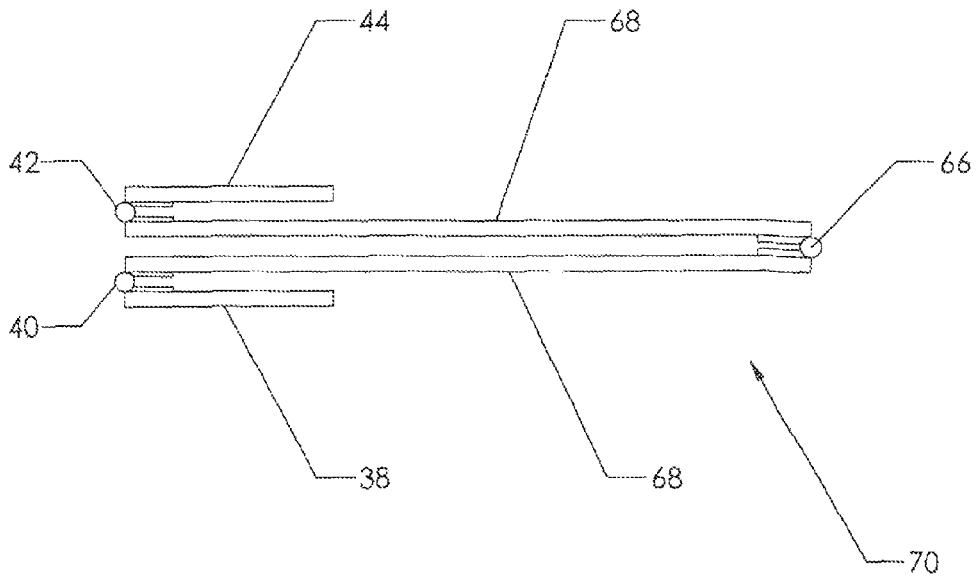
FIG. 15 is a side elevation view, showing the embodiment of FIG. 14 in a folded state.

FIGS. 14 and 15 illustrate still another embodiment in which the main panel has been split in half to enhance portability. FIG. 14 shows split panel embodiment 70 in an erected state. It is configured to reflect sound as for the prior embodiments. However, the reader will observe that the main panel has been divided into two pieces—each of which is designated as main panel half 68. The two halves are pivotally joined by center hinge 66. The left and right wings are pivotally connected by hinges as for the prior embodiments.

FIG. 15 shows the embodiment of FIG. 14 in a fully folded state. Center hinge 66 has been folded so that the two main panel halves 68 lie parallel. Likewise, the left wing 44 and right wing 38 have been folded. The result is a compact design which can be placed in a smaller carrying container.

The preceding description contains significant detail regarding the novel aspects of the present invention. It is should not be construed, however, as limiting the scope of the invention but rather as providing illustrations of the preferred embodiments of the invention. Numerous other variations will occur to those skilled in the art. Thus, the scope of the invention should be fixed by the claims presented, rather than by the examples given.

Having described my invention, I claim:

1. A method for laterally projecting sound from a piano having a horizontal soundboard, said piano resting on a floor, comprising:

a. providing a sound reflector, including
   i. a main panel, having a lower edge, a left edge, and a right edge,
   ii. a right wing, pivotally connected to said main panel proximate said right edge of said main panel, said right wing having a lower edge,
   iii. a left wing, pivotally connected to said main panel proximate said left edge of said main panel, said left wing having a lower edge,
   iv. wherein said right wing is movable between a folded position and a deployed position, with said right wing being parallel to said main panel when in said folded position,
   v. wherein said left wing is movable between a folded position and a deployed position, with said left wing being parallel to said main panel when in said folded position;

b. placing said left and right wings in said deployed position;

c. placing said sound reflector on said floor by placing said lower edges of said right wing, said main panel, and said left wing on said floor;

d. placing said sound reflector beneath said soundboard of said piano; and e. wherein said left and right wings are configured to place said main panel at an angle with respect to said floor between thirty degrees and seventy-five degrees.

2. A method for laterally projecting sound from a piano as recited in claim 1, wherein said left and right wings are configured to place said main panel at an angle with respect to said floor between fifty degrees and sixty degrees.

3. A method for laterally projecting sound from a piano as recited in claim 1, wherein:

a. said left wing is locked in said deployed position by a moveable left stay; and b. said right wing is locked in said deployed position by a moveable right stay.

4. A method for laterally projecting sound from a piano as recited in claim 3, wherein:

a. said left stay is pivotally attached to said main panel, with said left stay being moveable between a folded position in which said left stay lies parallel to said main panel and a deployed position in which said left stay engages said left wing and holds said left wing in position; and b. said right stay is pivotally attached to said main panel, with said right stay being moveable between a folded position in which said right stay lies parallel to said main panel and a deployed position in which said right stay engages said right wing and holds said right wing in position.

5. A method for laterally projecting sound from a piano as recited in claim 1, wherein:

a. said pivotal connecting between said right wing and said main panel is a right hinge;

b. said pivotal connection between said left wing and said left panel is a left hinge;

c. further comprising a first spring tending to bias said left panel toward said deployed state; and d. further comprising a second spring tending to bias said right panel toward said deployed state.

6. A method for laterally projecting sound from a piano as recited in claim 4, wherein:

a. said pivotal connecting between said right wing and said main panel is a right hinge;

b. said pivotal connection between said left wing and said left panel is a left hinge;

c. further comprising a first spring tending to bias said left panel toward said deployed state; and d. further comprising a second spring tending to bias said right panel toward said deployed state.

7. A method for laterally projecting sound from a piano as recited in claim 1, wherein said main panel is split into two halves which are pivotally joined by a center hinge.

8. A method for laterally projecting sound from a horizontally-oriented piano, said piano resting on a floor, comprising:
a. providing a sound reflector, including
i. a main panel, having a lower contacting portion, a left edge, and a right edge,
ii. a right wing, pivotally connected to said main panel proximate said right edge of said main panel, said right wing having a lower contacting portion,
iii. a left wing, pivotally connected to said main panel proximate said left edge of said main panel, said left wing having a lower contacting portion,
iv. wherein said right wing is movable between a folded position and a deployed position, with said right wing being parallel to said main panel when in said folded position,
v. wherein said left wing is movable between a folded position and a deployed position, with said left wing being parallel to said main panel when in said folded position;
b. placing said left and right wings in said deployed position;
c. placing said sound reflector on said floor by placing said lower contacting portions of said right wing, said main panel, and said left wing on said floor;
d. placing said sound reflector beneath said piano; and
e. wherein said main panel lies at an angle with respect to said floor between thirty degrees and seventy-five degrees.

9. A method for laterally projecting sound from a piano as recited in claim 8, wherein said left and right wings are configured to place said main panel at an angle with respect to said floor between fifty degrees and sixty degrees.

10. A method for laterally projecting sound from a piano as recited in claim 8, wherein:
a. said left wing is locked in said deployed position by a moveable left stay; and
b. said right wing is locked in said deployed position by a moveable right stay.

11. A method for laterally projecting sound from a piano as recited in claim 10, wherein:
a. said left stay is pivotally attached to said main panel, with said left stay being moveable between a folded position in which said left stay lies parallel to said main panel and a deployed position in which said left stay engages said left wing and holds said left wing in position; and
b. said right stay is pivotally attached to said main panel, with said right stay being moveable between a folded position in which said right stay lies parallel to said main panel and a deployed position in which said right stay engages said right wing and holds said right wing in position.

12. A method for laterally projecting sound from a piano as recited in claim 8, wherein:
a. said pivotal connecting between said right wing and said main panel is a right hinge;
b. said pivotal connection between said left wing and said left panel is a left hinge;
c. further comprising a first spring tending to bias said left panel toward said deployed state; and
d. further comprising a second spring tending to bias said right panel toward said deployed state.

13. A method for laterally projecting sound from a piano as recited in claim 11, wherein:
a. said pivotal connecting between said right wing and said main panel is a right hinge;
b. said pivotal connection between said left wing and said left panel is a left hinge;
c. further comprising a first spring tending to bias said left panel toward said deployed state; and
d. further comprising a second spring tending to bias said right panel toward said deployed state.

14. A method for laterally projecting sound from a piano as recited in claim 13, wherein said main panel is split into two halves which are pivotally joined by a center hinge.

15. A method for projecting sound from a horizontally-oriented piano, said piano resting on a floor, comprising:
a. providing a sound reflector, including
i. a main panel, having a lower contacting portion, a left edge, and a right edge,
ii. a right wing, pivotally connected to said main panel proximate said right edge of said main panel, said right wing having a lower contacting portion,
iii. a left wing, pivotally connected to said main panel proximate said left edge of said main panel, said left wing having a lower contacting portion,
iv. wherein said right wing is movable between a folded position and a deployed position, with said right wing being parallel to said main panel when in said folded position,
v. wherein said left wing is movable between a folded position and a deployed position, with said left wing being parallel to said main panel when in said folded position;
b. placing said left and right wings in said deployed position;
c. placing said sound reflector on said floor by placing said lower contacting portions of said right wing and said left wing on said floor;
d. placing said sound reflector beneath said piano;
e. wherein said main panel lies at an angle with respect to said floor between thirty degrees and seventy-five degrees.

16. A method for laterally projecting sound from a piano as recited in claim 15, wherein said left and right wings are configured to place said main panel at an angle with respect to said floor between fifty degrees and sixty degrees.

17. A method for laterally projecting sound from a piano as recited in claim 15, wherein:
a. said left wing is locked in said deployed position by a moveable left stay; and
b. said right wing is locked in said deployed position by a moveable right stay.

18. A method for laterally projecting sound from a piano as recited in claim 15, wherein:
a. said left stay is pivotally attached to said main panel, with said left stay being moveable between a folded position in which said left stay lies parallel to said main panel and a deployed position in which said left stay engages said left wing and holds said left wing in position; and
b. said right stay is pivotally attached to said main panel, with said right stay being moveable between a folded position in which said right stay lies parallel to said main panel and a deployed position in which said right stay engages said right wing and holds said right wing in position.

19. A method for laterally projecting sound from a piano as recited in claim 15, wherein:
a. said pivotal connecting between said right wing and said main panel is a right hinge;
b. said pivotal connection between said left wing and said left panel is a left hinge;
c. further comprising a first spring tending to bias said left panel toward said deployed state; and d. further comprising a second spring tending to bias said right panel toward said deployed state.

20. A method for laterally projecting sound from a piano as recited in claim 19, wherein:

a. said pivotal connecting between said right wing and said main panel is a right hinge;

b. said pivotal connection between said left wing and said left panel is a left hinge;

c. further comprising a first spring tending to bias said left panel toward said deployed state; and d. further comprising a second spring tending to bias said right panel toward said deployed state.

* * * * *